US007194941B2

(12) United States Patent
Vogl

(10) Patent No.: US 7,194,941 B2
(45) Date of Patent: Mar. 27, 2007

(54) APPARATUS FOR THE MANUFACTURE OF PERFORATED PLASTER BOARDS AS WELL AS METHOD FOR THE MANUFACTURE OF PERFORATED PLASTER BOARDS AND INSTALLATION THEREOF

(76) Inventor: Erich R. Vogl, Bahnhofswald 1, Emskirchen (DE) D-91448

( * ) Notice: Subject to any disclaimer, the term of this patent is extended or adjusted under 35 U.S.C. 154(b) by 0 days.

(21) Appl. No.: 10/455,608

(22) Filed: Jun. 6, 2003

(65) Prior Publication Data

US 2003/0226434 A1 Dec. 11, 2003

(30) Foreign Application Priority Data

Jun. 6, 2002 (DE) ..... 102 25 159

(51) Int. Cl.
*B26D 1/00* (2006.01)

(52) U.S. Cl. ..... 83/36; 83/39; 83/404; 83/404.1; 83/404.2; 83/405

(58) Field of Classification Search ..... 83/35, 83/39, 56, 404.1, 404.4, 405, 409.1, 425.2, 83/433, 660, 667, 151, 425.4, 681, 153, 155.1, 83/160, 682, 404.2, 452, 453, 458, 425.3, 83/431, 418, 435.15, 422; 414/270, 271
See application file for complete search history.

(56) References Cited

U.S. PATENT DOCUMENTS

| | | | | |
|---|---|---|---|---|
| 2,228,162 | A * | 1/1941 | Benham et al. | 83/300 |
| 2,272,703 | A * | 2/1942 | Haegele | 83/879 |
| 2,290,557 | A * | 7/1942 | Heath | 83/50 |
| 2,315,256 | A * | 3/1943 | Haegele et al. | 83/14 |
| 2,323,564 | A * | 7/1943 | Page | 52/673 |
| 4,048,887 | A * | 9/1977 | Morse et al. | 83/79 |
| 4,381,686 | A * | 5/1983 | Ess | 83/104 |
| 6,546,834 | B1 * | 4/2003 | Benuzzi | 83/36 |

FOREIGN PATENT DOCUMENTS

| | | |
|---|---|---|
| DE | 43 11 582 | 5/1994 |
| DE | 34 12 441 | 9/1994 |

* cited by examiner

*Primary Examiner*—Boyer D. Ashley
*Assistant Examiner*—Omar Flores Sánchez
(74) *Attorney, Agent, or Firm*—Browdy and Neimark, PLLC

(57) ABSTRACT

In an apparatus and a method for the manufacture of perforated plaster boards, provision is made for the operations of punching and cutting the sides to take place one directly after the other with the boards being held in position by grabbing and conveying equipments during the entire working time.

6 Claims, 2 Drawing Sheets

APPARATUS FOR THE MANUFACTURE OF PERFORATED PLASTER BOARDS AS WELL AS METHOD FOR THE MANUFACTURE OF PERFORATED PLASTER BOARDS AND INSTALLATION THEREOF

BACKGROUND OF THE INVENTION

1. Field of the Invention

The invention relates to an apparatus for the manufacture of perforated plaster boards as well as a method for the manufacture of perforated plaster boards and installation thereof.

2. Background Art

Conventionally, perforated plaster boards are made from a blank in such a way that cutting the long and short sides to size and punching the perforation takes place in operations separated in time and spatially. This leads to major tolerances on overall dimensions and on the position of the perforation relative to the outer edges.

Consequently, perforated boards of the generic type are conventionally placed in such a way that two adjacent boards, alongside their edges, are screwed to a beam, for example a metal section or a wood lath, in such a way that adjoining sides of the boards have a defined distance. The resulting joint is filled with plaster filler or structural adhesive, which requires a separate job that must be fulfilled by a correspondingly qualified craftsman.

SUMMARY OF THE INVENTION

It is an object of the invention to embody perforated plaster boards that excel by high dimensional accuracy and can easily be installed, it being desirable for a wall or ceiling thus produced to have an especially attractive outer appearance.

According to the invention, this object is attained in an installation comprising a first grabbing and conveying equipment with grabs for seizing a non-perforated plaster board by a first side, for inserting the plaster board in the punching device and for holding the plaster board during the punching operation; a second grabbing and conveying equipment with grabs for seizing, by a second side that is opposite the first side, a plaster board which has been punched in the punching device, the first grab being released only after the second grab has seized the respective plaster board, and the second grabbing and conveying equipment leading the respective plaster board in a first conveying direction through a first cutting station where two opposite sides of the plaster board are cut to size; a third grabbing and conveying equipment for seizing the plaster board, downstream of the first cutting station, by a side of the board that is displaced by 90° as compared to the side seized by the second grabbing and conveying equipment, the second grabbing and conveying equipment being released only after the third grabbing and conveying equipment has seized the plaster board, and the third grabbing and conveying equipment leading the plaster board through a second cutting station in a second conveying direction perpendicular to the first conveying direction, with second sides being cut to size that are perpendicular to the sides cut to size in the first cutting station.

A substantial feature of the apparatus according to the invention resides in that, from the instant when taken from a blank supply stack until deposit after finishing, the board is kept seized by the grabs without having any play; and in that, even when passed from one grab to the next, the board is kept engaged by at least one grab. This helps avoid tolerances on the dimensions of the long and short sides when cut to size as well as on the position of the perforation relative to the edges.

The grabs according to the invention may be operated mechanically, pneumatically or hydraulically. The terms 'cutting station' or 'cutting the board to size' imply that cutting to size may take place by sawing or milling or grinding, with edges of high dimensional accuracy being desired and regularly accomplished.

This offers the possibility of putting into practice a method of installation according to the invention, according to which the boards, as against prior art boards, are installed substantially jointless, directly abutting, so that there is no need for defined joint width nor for filling the joint. Substantially jointless installation means that the joint that remains according to the invention only has a width of few tenths of a millimeter, whereas it conventionally amounts to several millimeters.

For filling the remaining joint, provision can be made for adhesive or some similar material, for instance on the basis of silicone or dispersion-paint, to be applied to the front side of an installed board where an adjacent board is to abut so that, when another board is installed and joined laterally, the remaining joint is filled with squeezed glue.

The invention also relates to a method of manufacturing a perforated plaster board comprising the features outlined above. By advantage, provision can be made for advance of the boards in the punching device to take place modifiably program-controlled.

Owing to dimensional accuracy, an extraordinarily narrow fissure will remain between the boards, which can either be left as such and neglected or filled when the finished ceiling is painted.

To this end, a color is selected that will fill the fissure between two boards, simultaneously forming a smooth surface.

Details of the invention will become apparent from a preferred embodiment, taken in conjunction with the drawing.

DESCRIPTION OF THE PREFERRED EMBODIMENT

Figure 1:
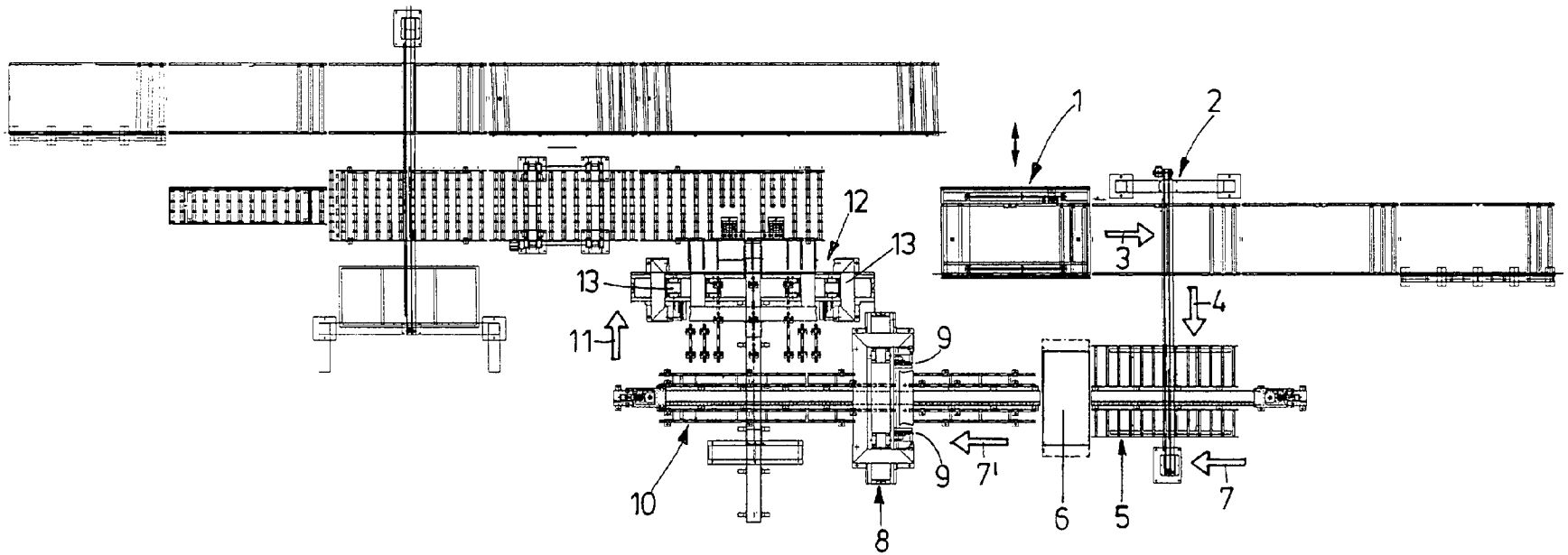
FIG. 1 is a diagrammatic plan view of an apparatus according to the invention.

As seen in the drawing, an apparatus according to the invention for the manufacture of perforated plaster boards comprises a stack 1 of blanks, with a board at a time being taken from the stack 1 by means of a conveying equipment 2, then conveyed in the direction of the arrow 3 and in the direction of the arrow 4 and deposited on a feeder 5.

This is where two grabs of a first grabbing and conveying equipment seize the single blank by its short side to the right in the drawing. Then the board, thus grabbed and positioned, is conveyed in the direction of the arrow "7" and positioned in a punching device 6 for the piercing tools of the punching device 6 to apply the desired perforation in accordance with a given, freely programmed pattern, with the grabs of the grabbing and conveying equipment holding the short side tight.

After the punching job, two grabs of a second grabbing and conveying device seize the plaster board by the opposite short side, moving it in the direction of the arrow "7" through a first cutting station 8 where the long sides of the plaster board are cut to size by two spaced and parallel saws 9.

The boards then arrive at a transfer station 10 where two grabs of a third grabbing and conveying equipment seize them by the long side at the top in the drawing. After seizing by those grabs, the two grabs of the second grabbing and conveying equipment are released and the board is led in the direction of the arrow "11", which is perpendicular to the previous conveying direction, through a second cutting station 12 with two spaced saws 13; the board is released only when supplied to a station for deposit and quality control, after which it is stored or dispatched.

Figure 2:
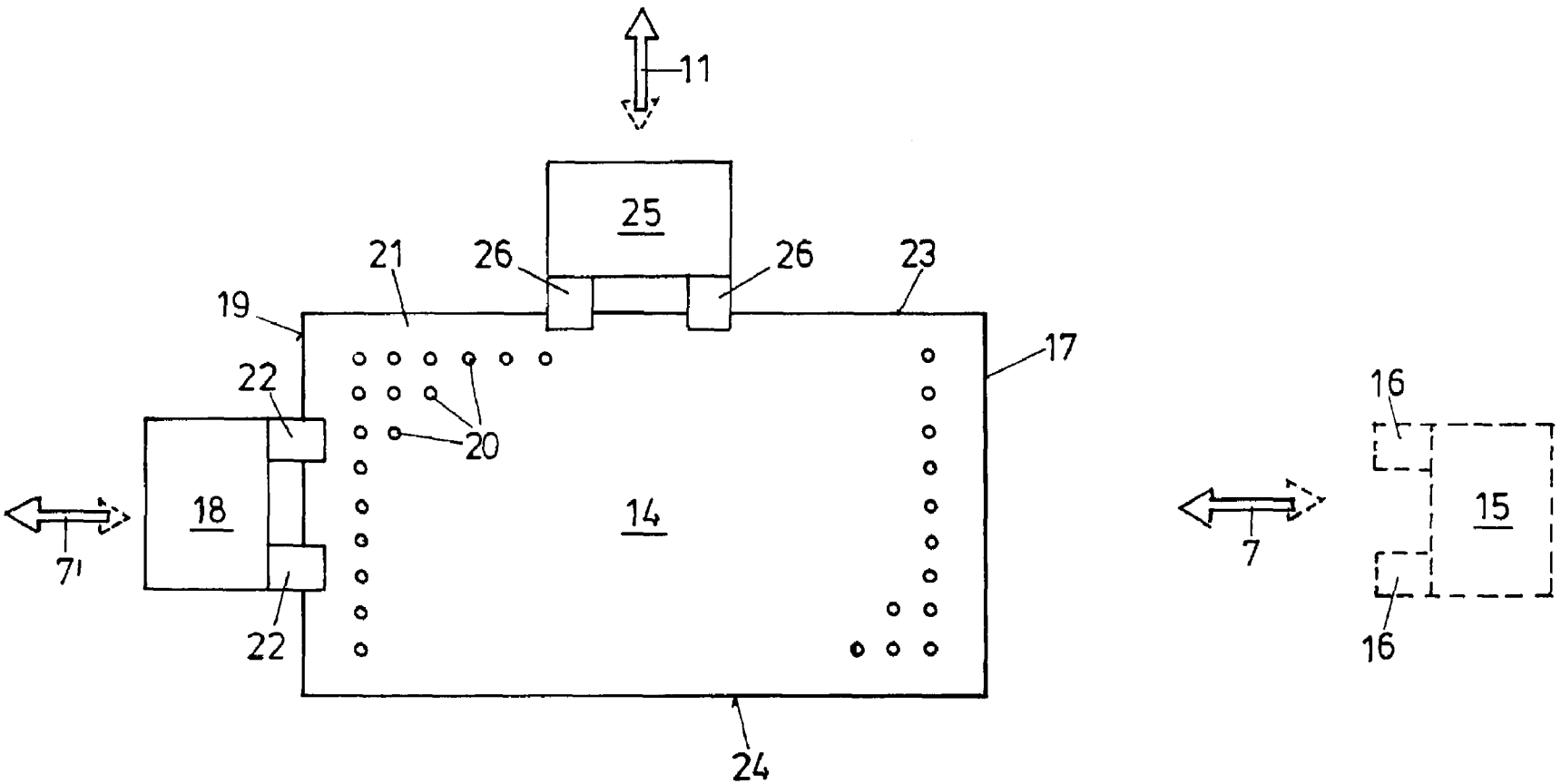
FIG. 2 is a diagrammatic plan view of a plaster board and the grabs that engage it.

FIG. 2 diagrammatically illustrates how a plaster board 14 is seized by the grabbing and conveying equipments.

The first grabbing and conveying equipment 15 has grabs 16 which are each formed by a pair of clamping jaws seize the first short side 17 of the board 14 upstream of the punching device 6 and lead the board 14 into the punching device 6 and are thereafter released from side 17. The first grabbing and conveying equipment 15 is roughly outlined by dashed lines in FIG. 2, which pictorializes the area of engagement.

The second grabbing and conveying equipment 18 seizes the board 14 by the second short side 19 that is opposite the first short side 17 when the board 14 is taken from the punching device 6 after the perforation 20 has been applied, with a margin 21 being left non-perforated. The clamping jaws of grabs 16 of the first grabbing and conveying equipment 15 are released only after engagement by grabs 22 of the second grabbing and conveying equipment 18 which have clamping jaws like those of grabs 16.

FIG. 2 is a concrete illustration of the situation at the transfer station 10 where the second grabbing and conveying equipment 18, by the grabs 22, still engages the margin 21 outside the perforation 20 after the long side 23 at the top in the drawing and the long side 24 at the bottom in the drawing have been cut to size in the first cutting station 8.

Grabs 26 of a third grabbing and conveying equipment 25 seize the margin 21 of the long side 23 with the grabs 22 still in engagement. Afterwards the grabs 22 are released and the board 14 can be conveyed in the direction of the arrow "11" through the second cutting station 12 where the short sides 17 and 19 are cut to size.

What is claimed is:

1. A method of manufacturing perforated plaster boards on an apparatus comprising a punching device (6) for generation of the perforation and cutting stations (8, 12) for cutting the sides of the boards to size; comprising the steps of:

first grabs (16) fixed to move laterally with a first movable conveyor (15) seizing and fixing within a first side (17) of a non-perforated plaster board (14) and then pushing the plaster board (14) laterally in a first conveying direction into the punching device (6) to be punched;

thereafter, second grabs (22) fixed to move laterally with a second movable conveyor (18) seizing and fixing within a second side (19) opposite the first side (17) of the punched plaster board (14), the first grabs (16) being released only after the second grabs (22) have seized the second side (19), the second grabs (22) then pulling the punched plaster board (14) in the first conveying direction through the first cutting station (8) where two opposite long sides (23, 24) of the punched plaster board (14) are cut to size;

thereafter, third grabs (26) fixed to move laterally with a third movable conveyor (25) seizing and fixing within a third side of the punched plaster board (14) that is displaced by 90° compared to the second side, the second grabs (22) being released only after the third grabs (25) have seized the punched plaster board (14), the third grabs (26) pulling the punched plaster board (14) through a second cutting station (12) in a second conveying direction (7) perpendicular to the first conveying direction (7) with the third side (19) and a fourth side (17) that are perpendicular to the first and second sides (23, 24) being cut to size in a second cutting station.

2. The method according to claim 1, wherein the first, second and third grabs are respectively at least one pair of clamping jaws.

3. The method according to claim 1, wherein the first second and third grabs are respectively two pairs of clamping jaws.

4. The method according to claim 1, wherein advance of the boards in the punching device (6) takes place modifiably program-controlled.

5. The method according to claim 1, wherein the boards are installed substantially jointless, directly abutting, with a fissure that may remain being filled by painting of a finished ceiling.

6. The method according to claim 5, wherein an adhesive material is applied to front sides of the installed boards, filling a remaining joint upon installation of an adjoining board when it is pressed against the installed board.

* * * * *